US006116938A

United States Patent [19]

Myer et al.

[11] Patent Number: 6,116,938

[45] Date of Patent: Sep. 12, 2000

[54] LOW PROFILE ELECTRICAL CONNECTOR

[75] Inventors: John Mark Myer, Millersville; Forrest Irving Kinsey, Jr., Harrisburg, both of Pa.

[73] Assignee: The Whitaker Corporation, Wilmington, Del.

[21] Appl. No.: 08/920,246

[22] Filed: Aug. 28, 1997

[51] Int. Cl.[7] ..... H01R 13/627; H01R 13/52

[52] U.S. Cl. ..... 439/353; 439/271

[58] Field of Search ..... 439/350–358, 439/587–589, 274, 275, 279, 271

[56] References Cited

U.S. PATENT DOCUMENTS

| | | | |
|---|---|---|---|
| 4,639,061 | 1/1987 | Muzslay | 439/357 |
| 4,944,688 | 7/1990 | Lundergan | 439/275 |
| 5,083,933 | 1/1992 | Colleran et al. | 439/357 |
| 5,190,467 | 3/1993 | Ohta | 439/354 |
| 5,308,261 | 5/1994 | Kightlinger | 439/358 |
| 5,399,045 | 3/1995 | Yoneda et al. . | |
| 5,451,717 | 9/1995 | Itou | 174/77 R |
| 5,562,477 | 10/1996 | Moore et al. | 439/383 |
| 5,634,807 | 6/1997 | Saito | 439/275 |
| 5,803,759 | 9/1998 | Griffith et al. | 439/274 |

OTHER PUBLICATIONS

Amp Sealed connectors, Part No. 184026–1, Downloaded 7–14–97, 2 sheets No Date.

AMP SCC (Sealed Sensor Connector System), General Information, Downloaded 7–17–97, 2 sheets.

*Primary Examiner*—Lincoln Donovan
*Assistant Examiner*—Chandrika Prasad

[57] ABSTRACT

The electrical connector (2) is a sealed electrical connector including terminals (4) located in two rows in a connector housing (6). In addition to the terminals (4) and the housing (6), the connector (2) also includes a wire seal cap (8) that is mounted on the rear of the housing (6). The cap (8) includes a latch (10). A wire seal (12) is positioned between the rear face of the connector housing (6) and the wire seal cap (8). A ring seal (14) maintains sealing integrity between the sealed electrical connector (2) and a mating connector or tab connector (16). The wire seal (12) engages wires (18) attached to the terminals (4) at the rear of the connector (2). The connector housing also includes a shroud (20) through which the latch (10) extends, and the latch (10) engages the mating connector (16) to latch the two connectors in mating engagement. Since the latch (10) is molded as part of the seal cap (8) and not part of the housing (6), the height of the shroud (20), beneath which the shroud extends, can be reduced so that the overall height of the connector is less than for a conventionally shrouded connector.

25 Claims, 3 Drawing Sheets

LOW PROFILE ELECTRICAL CONNECTOR

BACKGROUND OF THE INVENTION

1. Field of the Invention

This invention is related to electrical connectors that employ latches to secure the electrical connector to a mating connector or header. More particularly this invention is related to electrical connectors in which the latch and the connector housing are molded. This invention is also related to sealed electrical connectors.

2. Description of the Prior Art

Electrical connectors commonly employ a resilient latch to physically attach one electrical connector to another. Typically these latches comprise molded flexible latches that are part of a molded connector housing. One form of these latches is a see-saw latch in which the latch is joined to the housing in the middle of the latch with a locking surface at a forward end and a tab located on the opposite end of the latch. The latch then pivots about the central point where it is attached to the housing. U.S. Pat. No. 4,944,688 shows a see-saw latch of this type in which the latch is part of a molded seal cap that is attached to the rear of the connector housing. The latch in that patent is located on the seal cap instead of the connector housing so that the housing can be more easily manipulated by automated equipment so that the latch will not be in the way.

Other electrical connectors employ cantilever beam latches having a base attached to the connector housing and a locking surface located toward the deflectable free end of the cantilever beam latch. U.S. Pat. No. 5,562,477 is an example of a cantilever beam latch in which the locking surfaces are located in the middle of the beam and pressure is applied to the free end of the beam to deflect the latch. The base of the latch is located adjacent the mating face of the connector housing. U.S. Pat. No. 5,634,807 shows a connector in which the base of a cantilever latch is located at the rear of the connector housing. The locking surface is located at the free end of the cantilever latch and pressure can be applied between the base and the locking surface. U.S. Pat. No. 5,399,045 discloses connectors with latches joined to the housing at the rear end and others joined to the housing at both ends of the housing.

The two latter patents also show connectors in which a hood or shroud extends from the housing over the locking surface on the latch. This hood can serve to prevent inadvertent disengagement of the locking surface or facilitate automated handling of the connector housing. The locking surface will not be exposed to wires or other implements which may snag the locking surface. Although these hoods or shrouds are advantageous features, they do increase the height of the connector housing. Gaps must be formed below the latch to permit inward deflection of the latch and a gap must be located on the top of the latch in order to separate the hood from the latch. In order to mold both the hood and the portion of the latch located below the hood, mold tooling must be located above and below the location of the latch. This tooling is typically moved axially relative to the latch when the connector housing is removed from the mold. This mold tooling must be thick enough to avoid damage to the tooling and these clearances add height to the final configuration of the hood and the connector housing.

SUMMARY OF THE INVENTION

In order the reduce the overall height of a shrouded connector receptacle connector housing, a cantilever connector latch is molded as part of a separate piece that can be attached to a connector housing having a shroud extending from one side of the housing. The latch extends beneath the shroud after the separate piece is attached to the connector housing. By molding the latch on the separate member, additional clearance between the molded shroud and molded latch, which is necessary when both the shroud and the latch are molded on the housing at the same time, can be eliminated. The shroud is lower and the overall height of the connector housing is therefore reduced. Connectors can be latched in the same manner as conventional shrouded connector housings. The shroud still offers the same protection to the latch and the latch is not exposed to entanglement, inadvertent unlatching or to assembly tooling with which the connector is used. For a sealed connector, a cantilever beam latch can be molded as an integral part of the seal cap, and no additional pieces are necessary. Furthermore no additional assembly steps are necessary.

The cantilever beam latch includes locking surfaces located on opposite edges of the free end of the forwardly extending cantilever latch. Companion locking surfaces on a mating connector engage these locking surfaces beneath the connector shroud and cam the free end of the latch inwardly during mating. When fully mated the flexible cantilever latch returns to its normal position and the locking surfaces on the two connectors engage to prevent separation of the connectors. To disengage the latch, pressure can be applied to an exposed gripping surface to inwardly deflect the latch and disengage the locking surfaces.

DETAILED DESCRIPTION OF THE PREFERRED EMBODIMENT

Figure 1:
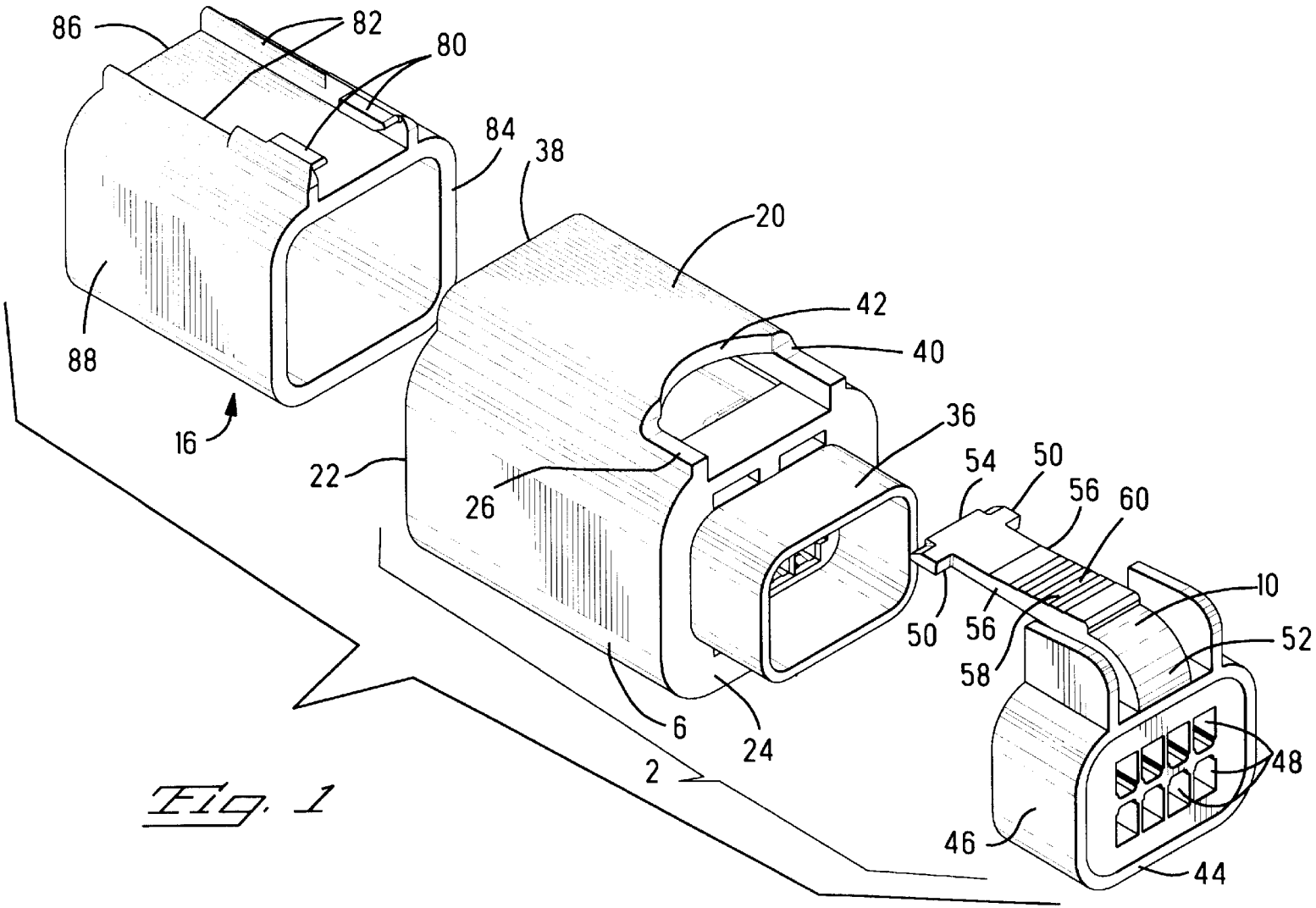
FIG. 1 is an exploded view of the preferred embodiment of a sealed electrical connector and a mating connector.
Figure 2:
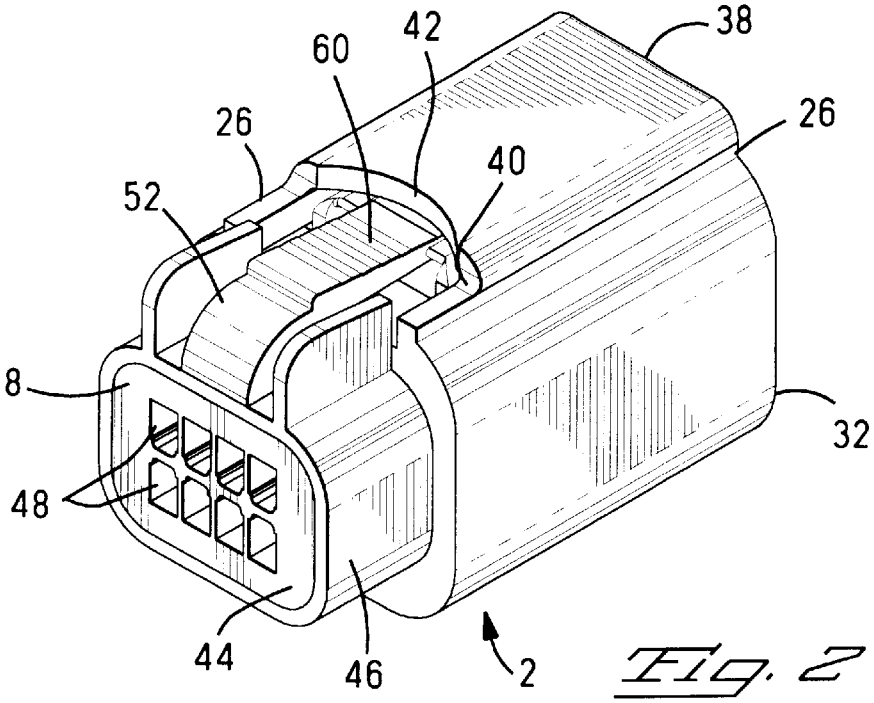
FIG. 2 is a view of the sealed connector showing the seal cap mounted on the rear face of the connector housing.

The electrical connector 2 comprising the preferred embodiment of this invention is a sealed electrical connector. The preferred embodiment of this electrical connector 2 is an eight position connector with terminals 4 located in two rows in a connector housing 6. In addition to the terminals 4 and the housing 6, the connector 2 also includes a wire seal cap 8 that is mounted on the rear of the housing 6. The cap 8 includes a latch 10. A wire seal 12 is positioned between the rear face of the connector housing 6 and the wire seal cap 8. A ring seal 14 maintains sealing integrity between the sealed electrical connector 2 and a mating connector or tab connector 16. The wire seal 12 engages wires 18 attached to the terminals 4 at the rear of the connector 2. The connector housing also includes a shroud 20 through which the latch 10 extends, and the latch 10 engages the mating connector 16 to latch the two connectors in mating engagement.

Terminals 4 are conventional crimp snap electrical connector terminals that are each crimped to individual wires 18. These terminals 4 have a mating section located adjacent to the mating face 22 of the connector 2, and the terminals are inserted into the connector housing through a rear face 24 of the connector housing 6.

The connector housing 6 is molded from a conventional thermoplastic, and the housing is configured so that it can be molded by simple straight pull mold tooling that only moves perpendicular to the mating face 22 and rear face 24 of the connector housing 6. This configuration simplifies molding and makes the connector housing less expensive to manufacture. Connector housing 6 has a central section 28 having two rows of terminal cavities 30 The connector housing 6 also has an outer rim 32 which is spaced from the central housing section 28 and forms three sides of a channel 34 that extends around the central housing section 28.

A shroud 20 is located on the fourth or top side 26 of the housing and is spaced further from the central housing section 28 to provide additional clearance for the latch 10. The shroud 20 extends between a front end 38, adjacent the mating face 22 of the connector housing 6 and a rear end 40. A curved recess edge 42 is located on the rear shroud end 40 which is in turn spaced forward of the rear connector housing face 24. The shroud 20 forms an opening between the front end 38 and the rear end 40 so that latching members on both connectors can be inserted through the shroud 20 and below the top surface of the shroud 20. In the preferred embodiment, the shroud 20 has a generally U-shaped cross section with the width of the top of the shroud 20 being greater than the height.

The connector housing 6 also includes a skirt 36 on the rear face 24. The wire seal 12 is positioned within the skirt 36 and the wire seal cap 8 is mounted on the exterior of the skirt 36. Snap latches (not shown) of conventional configuration are located on the ends of the skirt and engage mating snap latches (also not shown) located on the wire seal cap 8 so that the wire seal cap 8 can be attached to the rear face 24 of the connector housing 6.

The wire seal cap 8 serves two independent functions. First the cap 8 secures the wire seal 12 in place on the rear face 24 of the connector housing 6 so that the seal 12 is positioned between the connector housing 6 and the seal cap 8. The cap 8 also includes a cantilever beam latch 10 extending from the top of the seal cap 8 and this latch 10 engages a companion surface on a mating connector 16 to lock the housings of the two connectors together when the connectors are mated.

Wire seal cap 8 has a rear wall 44 with cap side walls 46 extending forwardly from the periphery of the rear cap wall 44 on each of the four sides of cap 8. Latch 10 extends from the top side wall. The housing skirt 36 is received within the four cap side walls 46 and the cap 8 is snapped to the connector housing 6 along the end side walls 46 and end walls of skirt 36 in a conventional manner. The cap 8 also includes holes 48 extending through the rear wall 44, and wires 18 extend through each hole 48 when attached to terminals 4 positioned in the housing cavities 30. The seal cap 8, including the latch 10 is an integrally molded member that can be formed by straight pull tooling with no need for undercuts. Conventional thermoplastics can be used to mold cap 8, but a material that will allow some flexing of the latch 10 must be used. In the preferred embodiment, both the connector housing 6 and the cap 8 are molded from a common thermoplastic such as PBT.

The latch 10 is a cantilever beam with connector locking surfaces 50 located at the free end 54, which is forward of the base 52 that joins the top cap side wall.

Two connector locking surfaces 50 are located on each of the two side edges 56 of the latch 10. The height and width of the latch 10 is such that the free end 54 and the locking surfaces 50 can be inserted through and beneath the shroud 20 from the rear shroud end 40 when the seal cap 8 is mounted to the mating face 22 of the connector housing 6. When the cap 8 and latch 10 are positioned in this manner, a central latch portion 58 between the base 52 and free end 54 is exposed. The curved recessed shroud portion 42 increases the exposed area at the center of the latch 10. A ribbed gripping surface 60 is formed on the exterior of the exposed latch portion 50 and pressure applied to the gripping surface 60 deflects the latch 10 inwardly for unlatching the two connectors. Upstanding ribs are located beside the latch base 52, and these ribs help prevent inadvertent deflection of the latch 10.

Figure 3:
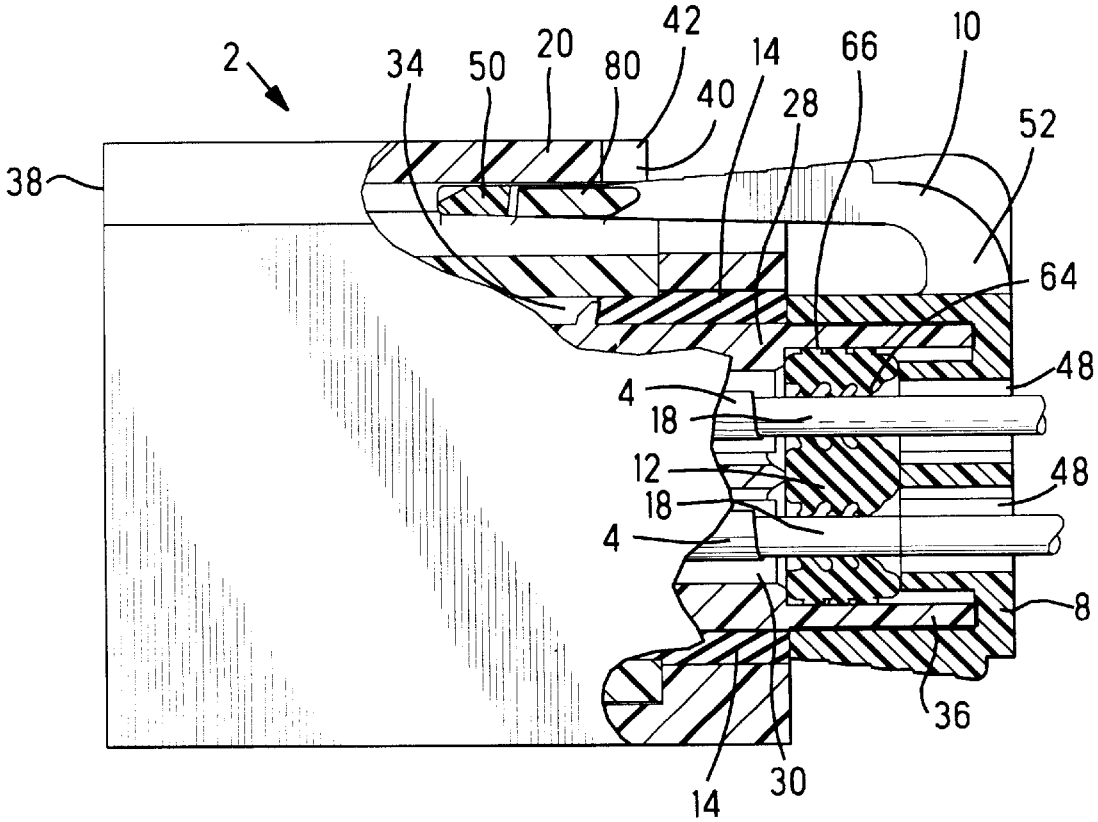
FIG. 3 is a section view of the sealed electrical connector mated with a mating connector.
Figure 4:
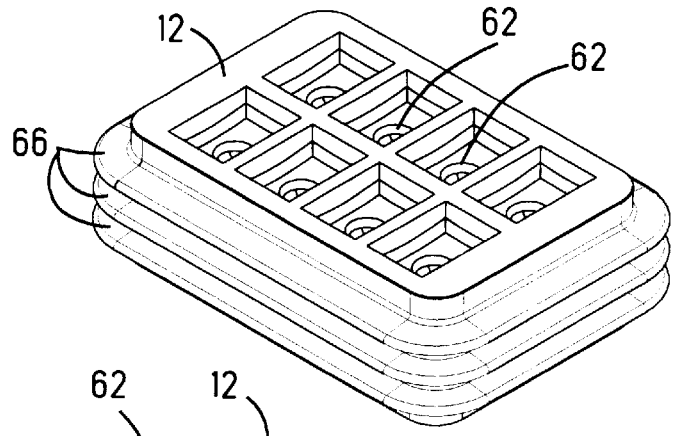
FIG. 4 is a view of the wire mat seal.
Figure 5:
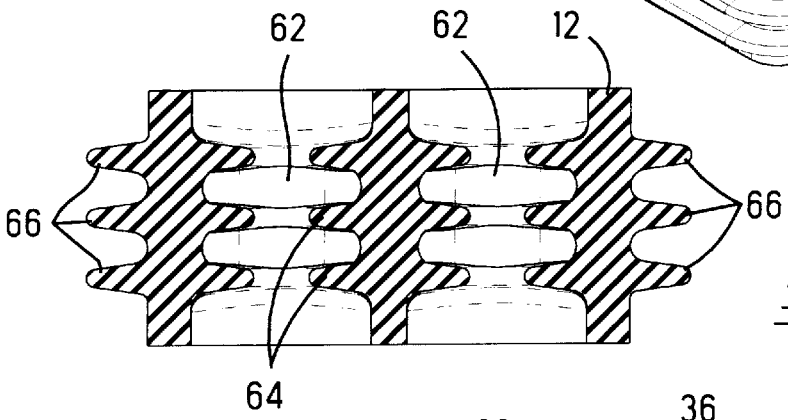
FIG. 5 is a partial section view of the seal showing the openings through which the wires extend.
Figure 6:
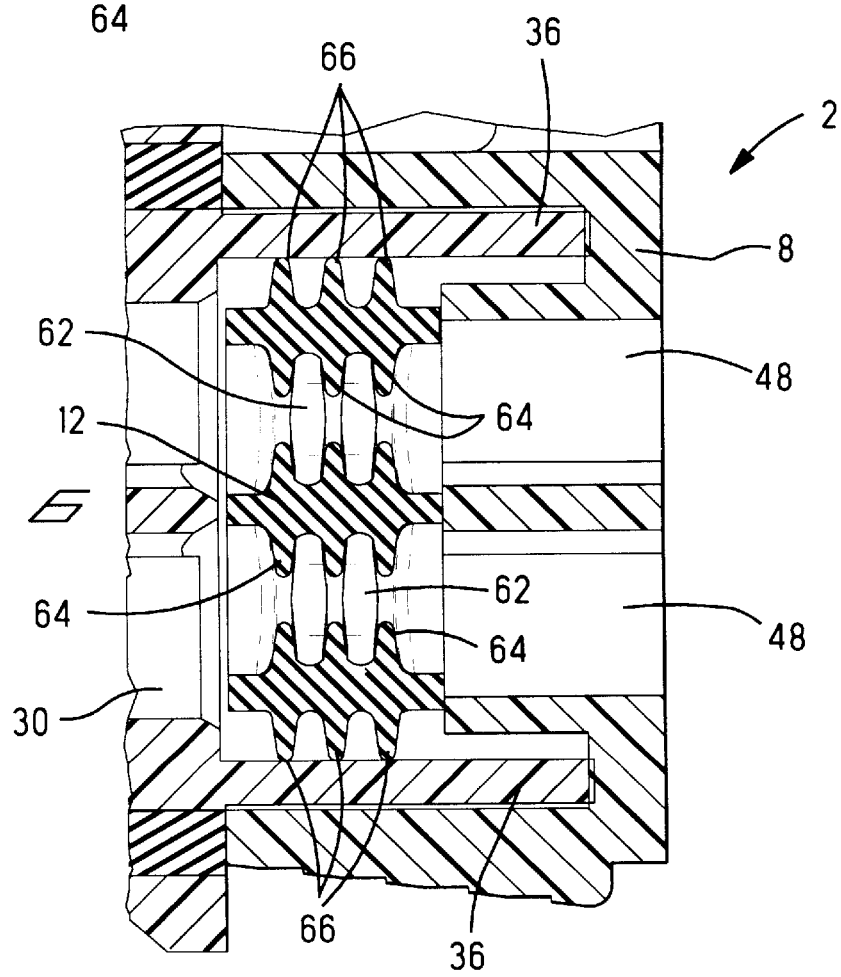
FIG. 6 is a view of the mat wire seal showing the deflection of the peripheral seal ribs or glands which does not cause distortion of the inner seal ribs or glands that will engage a wire extending through the seal.

Sealing integrity around wires 18 is maintained by mat wire seal 12. The seal 12 can be fabricated from a conventional resilient material, such as silicone rubber, that is commonly used in sealed electrical connectors. This wire seal has seal openings 62 that are aligned with the terminal cavities 30 and the holes 48 in the seal cap 8. Inner seal ribs 64 are located on the inner surface of each of these seal openings. Outer seal ribs 66 are located around the periphery of the seal 12 and these outer ribs 66 engage the inner surface of the skirt 36 in which the wire seal 12 is positioned. The height of the inner seal ribs 64 is such that when wires 18 are inserted through the openings 62, the ribs are deflected along the axis of the wires with pressure exerted by the seal ribs 64 on the wires 18 being derived primarily from the deflection of the ribs 64 instead of compression of the seal. Similarly, the height of the outer seal ribs 66 is such that these ribs are also deflected when inserted into the skirt 36 so that axial deflection of the seal ribs, instead of compression, generates most of the force that maintains sealing integrity. Note, that the outer seal ribs 66 are deflected in the opposite direction from the inner seal ribs 64. As shown in FIGS. 5 and 6, the height and width of the outer seal ribs or glands 66 is chosen so that these outer seal ribs or glands 66 deflect laterally when inserted into the skirt 36 and the body of the mat seal 12 is not significantly compressed. For example in the preferred embodiment of this invention the height of an outer seal rib or gland 66 could typically be 1.0 mm with adjacent ribs or glands on 1.00 mm centerlines. The radius at the base of these outer seal ribs or glands could typically be 0.40 mm and the radius at the tip could be 0.15 mm. In the preferred embodiment at least one seal opening 62 is typically 3 mm from the outer edge of the adjacent peripheral sealing gland 66. The seal could be formed from an approximately 27 A durometer silicone rubber. Since there is no significant compression of the body of mat wire seal 12, there is also no deformation of the inner seal ribs or glands 64 extending into the seal openings 62. Therefore the seal openings 62 are not deformed and maintain their original shape, which in this embodiment would be generally circular cross sections. Since the seal openings are not deformed the inner seal ribs or glands 64 are also not deformed and the spacing between adjacent inner seal ribs or glands 64 is unaffected by insertion of the seal 12 into the skirt 36. Therefore there is sufficient space for the inner seal ribs or glands 64 to deflect laterally when wires 18 and terminals 4 are inserted from the rear as shown in FIG. 3. The advantage of using a seal with deflecting seal ribs or glands around the periphery of the seal, instead of using a seal in which the seal ribs or glands and the body of the seal are compressed is that the overall size of the seal can be reduced because compression of the body does not deform the shape of the wire seal openings and inner seal ribs. If the overall size of the seal does not have to be increased, the size of the housing does not have to be increased and therefore the overal cost of the connectors need not be increased in order to avoid the effects due to seal compression. By eliminating inward deformation of the inner seal ribs or glands 64, which would reduce the size of seal openings 62, it is also possible to avoid damage to the inner seal ribs or glands 64 when terminals attached to the wires are inserted through the seal openings 62.

The mating connector 16 is a tab connector having companion mating surfaces 80 that engage locking surfaces 50 on latch 10 when the electrical connector 2 is mated with the mating electrical connector 16. Each of these companion mating surfaces 80 extend inwardly from the tops of rails 82 on the top of the mating connector tab housing 88 so that a space is formed between the mating connector housing 88 and the companion surfaces 80. This space is sufficient to allow the locking surfaces 50 at the free end 54 of the latch 10 to pass beneath the companion mating surfaces 80 when the latch 10 is deflected inwardly during mating or unmating. When the two connectors are fully mated, the locking surfaces 50 will be positioned behind the companion locking or mating surfaces 80. The mating connector 16 also has a forward face 84 positioned for receipt with the channel 34 surrounding the central housing section 28. The companion mating or locking surfaces 80 are spaced from the forward face 84 and the rails 82 extend from the companion locking surfaces 80 and the rearward face of the mating connector 16.

The connector 2 is assembled by first positioning the ring seal 14 in the channel 34 surrounding the central housing section 28 and by positioning the wire mat seal 12 in the skirt 36 on the rear of the housing 6. The ring seal 14 is inserted from the front of the connector housing 6 and the wire mat seal 12 is inserted from the rear. The seal cap 8 is then snapped to the rear of the housing 6 by the conventional snaps, not shown on the ends of the skirt 36 and the cap 8. When the cap 8 is attached to the housing 6, the latch free end 54 is inserted from the rear beneath the shroud 20. After the cap 8 is attached to the housing 6, terminals 4 attached to wires 18 are inserted through the aligned cap wire holes 48 and seal openings 62 into the corresponding terminal cavities 30. With the connector 2 assembled in this manner the mating tab connector 16 can be mated with connector 2. Mating connector 16 includes tabs, not shown, that are matable with the receptacle terminals 4. The tab connector mating face 84 is configured for receipt within the channel 34 formed around the central housing section 28 of connector 2. The ring seal 14 establishes a seal with the inner surface of the tab housing 88. The protruding mating surface 80 on tab connector housing 88 is inserted through the front shroud end 38 beneath the shroud 20. The inwardly directed companion mating surfaces 80 are brought into engagement with the locking surfaces 50 on latch 10 Further movement of the mating connector 16 toward connector 2 causes companion locking surfaces 80 to inwardly cam the latch locking surfaces 50 and deflect the cantilever latch 10 until the two connectors are fully mated. When mating is complete, the latch free end 54 snaps back into its normal position after the locking surfaces 50 and 80 have cleared. Locking surfaces 50 are then positioned behind companion surfaces 80 and the two connectors are firmly latched together. To disengage the two connectors pressure is applied to the exposed gripping surfaces 60 intermediate the ends of the latch 10 to deflect the latch inwardly and free locking surfaces 50 from the companion locking surfaces 80 so that the connectors can be disengaged. Although the extent of the travel of the latch 10 during mating and unmating is substantially the same as the travel for a conventionally shrouded latch formed integrally with the connector housing, the total height of the housing and shroud can be reduced by approximately 2.5 mm by forming the latch 10 on a separate cap 8. Since the latch 10 is molded separately there is no need to provide clearance between the shroud 20 and the latch 10. Therefore the height of the shroud 20 and the overall connector height can be reduced in this manner, making the connector suitable for more densely packed applications.

What is claimed is:

1. An electrical connector comprising:

a connector housing having a mating face and a rear face and including means for positioning at least one terminal attached to a wire;

the connector housing including a shroud on one side thereof, the shroud being open between front and rear ends thereof; and a deflectable latch attachable to the connector housing at the rear face of the housing, the latch extending partially through the shroud toward the front end of the shroud, the latch having a connector locking surface positioned within the shroud for engaging a companion surface on a mating connector when the companion surface is inserted into the shroud so that the connector is locked to the mating connector and the shroud covers the locking surface and the companion locking surface.

2. The electrical connector of claim 1 wherein the latch is part of a cap attachable to the rear face of the connector housing.

3. The electrical connector of claim 1 wherein the latch comprises a cantilever member extending from a base adjacent to the rear face of the housing with the locking surface located adjacent the free end of the cantilever member, a portion of the cantilever member adjacent to the base being exposed when the locking surface is received in the shroud so that pressure on the exposed portion of the cantilever member will deflect the locking surface.

4. The electrical connector of claim 1 wherein locking surfaces are located on opposite edges of the latch.

5. The electrical connector of claim 4 wherein the locking surfaces are deflectable beneath the companion surfaces on the mating connector during mating.

6. A sealed electrical connector comprising:

a connector housing;

terminals positioned in the connector housing, each terminal being attachable to a wire;

a wire seal with openings through which wires attached to the terminals can extend;

a seal cap attachable to the housing with the wire seal being positioned between the connector housing and the seal cap;

a latch on the seal cap for engaging a mating connector; and a shroud on the connector housing, the latch on the seal cap extending beneath the shroud.

7. The sealed electrical connector of claim 6 wherein the latch comprises a cantilever beam latch with a base integral with the seal cap with the latch extending from the seal cap toward a mating face of the connector housing.

8. The sealed electrical connector of claim 7 wherein a portion of the cantilever beam latch between the base and a free end of the latch is exposed when free end of the latch extends beneath the shroud, so that pressure on the exposed portion deflects the free end.

9. The sealed electrical connector of claim 8 wherein the free end of the latch includes a locking surface for engaging a companion surface on a mating connector to latch the sealed electrical connector to the mating connector.

10. The sealed electrical connector of claim 6 wherein the shroud comprises an integral part of a molded connector housing wherein opposite edges of the shroud are joined to a top side of the connector housing.

11. An electrical connector comprising terminals, a molded connector housing, and a latch wherein:

the molded connector housing includes a central section including cavities in which the terminals are positioned and an outer rim spaced from the central section to define a channel in which a portion of a mating connector housing can be received between the central section and the rim, the rim further including a shroud on one side of the housing protruding above the channel and forming additional clearance into which the latch can be inserted, the shroud having an open front and rear end;

the electrical connector being characterized in that the latch comprises a separate member attachable to the molded connector housing so that the overall height of the molded connector housing can be reduced.

12. The electrical connector of claim 11 wherein the latch can be attached to that molded connector housing adjacent to a rear face of the housing with a portion of the latch extending beneath the shroud.

13. The electrical connector of claim 12 wherein the latch extends integrally from a molded cap that is attachable to the connector housing on the rear end.

14. The electrical connector of claim 13 wherein the latch comprises a cantilever beam extending from the cap toward a mating face of the electrical connector.

15. The electrical connector of claim 14 wherein the housing includes a skirt on a rear face thereof, the cap being positioned over the skirt.

16. The electrical connector of claim 15 further comprising a seal positioned within the skirt with the seal being held in position by the cap.

17. The electrical connector of claim 16 wherein the cap is attached to the skirt.

18. The electrical connector of claim 14 wherein the latch includes a locking surface adjacent the free end of the cantilever member.

19. The electrical connector of claim 18 wherein the locking surface is inwardly deflectable beneath the shroud.

20. The electrical connector of claim 18 wherein locking surfaces are located on opposite edges of a free end of the latch.

21. A wire seal for use with an electrical connector, the wire seal being mounted in a connector housing and comprising:

a deformable body having a plurality of openings through which wires can be inserted;

outer seal glands surrounding the seal body, the outer seal glands being configured to engage housing walls on the electrical connector when the wire seal is mounted on the electrical connector to maintain sealing integrity between the wire seal and the connector housing;

inner seal glands extending into the seal openings, the inner seal glands being configured to engage a wire inserted into the seal openings to maintain sealing integrity between the wire seal and the wire in the corresponding seal opening; and the wire seal being characterized in that the outer seal glands are configured to axially deflect when mounted on the electrical connector without imparting sufficient compression to the seal body to deform the seal openings or the inner seal glands.

22. The wire seal of claim 21 wherein the inner seal glands are configured to axially deflect upon insertion of a wire into a corresponding seal opening.

23. The wire seal of claim 21 wherein the wire seal has an approximately 27 A durometer.

24. The wire seal of claim 21 wherein the inner seal glands are axially deflectable to permit passage of a terminal attached to a wire through a corresponding seal opening without damage to the inner seal glands.

25. The wire seal of claim 21 wherein the wire seal is configured for receipt with a skirt on the connector housing surrounding the wire seal, the outer seal glands deflecting axially upon insertion into the skirt.

* * * * *